US005143100A

United States Patent [19]

Kawakami

[11] Patent Number: 5,143,100

[45] Date of Patent: Sep. 1, 1992

[54] MANICURE SHEET

[76] Inventor: Mikako Kawakami, 3-28-1103, Honden 1-chome, Nishi-ku, Osaka, Japan

[21] Appl. No.: 781,728

[22] Filed: Oct. 23, 1991

[30] Foreign Application Priority Data

Nov. 20, 1990 [JP] Japan ..... 2-122212

[51] Int. Cl.[5] ..... A45D 29/00

[52] U.S. Cl. ..... 132/285; 132/73

[58] Field of Search ..... 132/73, 73.5, 285, 319

[56] References Cited

U.S. PATENT DOCUMENTS

| | | | |
|---|---|---|---|
| 2,031,225 | 2/1936 | O'Donnell | 132/285 |
| 2,239,040 | 4/1941 | Holmes | 132/285 |
| 2,287,062 | 6/1942 | Powers et al. | 132/285 |
| 2,323,145 | 6/1943 | Mabry | 132/285 |
| 2,580,893 | 1/1952 | Dee | 132/285 |
| 2,799,282 | 7/1957 | Slaek | 132/285 |
| 3,461,885 | 8/1969 | Coveney | 132/285 |
| 4,682,612 | 7/1987 | Giuliano | 132/73 |
| 4,690,369 | 9/1987 | Giuliano | 132/73 |
| 4,924,889 | 5/1990 | Schaeffer et al. | 132/73 |
| 4,947,876 | 8/1990 | Larsen | 132/285 |

FOREIGN PATENT DOCUMENTS

| | | | |
|---|---|---|---|
| 3642534 | 6/1988 | Fed. Rep. of Germany | 132/73 |

*Primary Examiner*—Gene Mancene
*Assistant Examiner*—Frank A. LaViola
*Attorney, Agent, or Firm*—Koda & Androlia

[57] ABSTRACT

A manicure sheet for use in manicuring fingernails comprising a left-and-right pair of masking sheets which are stuck onto the left and right halves of the fingertip for masking skin parts proximate to the nail. Each sheet has in its tip part an L-shaped incision (11) defined by a basal side (12) corresponding to the nail's basal edge and a perpendicular side (13) corresponding to either of the nail's opposite edges. The sum of the lengths of the joined basal sides of the L-shaped incisions in the left-and-right pair of masking sheets (1) and (2) is made larger than the length of the basal side of the nail.

7 Claims, 5 Drawing Sheets

MANICURE SHEET

BACKGROUND OF THE INVENTION

1. Field of the Invention

The present invention relates to a manicure sheet used for masking the skin proximate to the nail being manicured.

2. Prior Art

Manicure has long been one of intimate arts for improving the beauty of nails and fingers. Generally manicure is applied by one who wants her nails manicured by applying with a tiny brush to her nails an oily nail enamel procurable from a cosmetic store. Recently, however, care of fingers and manicure by cosmetologists have become popular and with that manicure technique has come to be fast improved.

As one of such new manicure techniques there is now known a method in which nails are sprayed with aqueous nail colors for producing colorful patterns. To explain it in detail, the procedure consists in first applying a base coat (normally a clear oily nail enamel) with a brush, then spray aqueous nail color/s in one or more layers and finally finish by applying a top coat (normally also a clear oily nail enamel) with a brush.

In the technique, there arises no risk of the base coat or the top coat being mis-applied out of the nails because such coat is applied by brushing. The aqueous manicure colors, however, are applied by spraying, thus are likely to stain the skin proximate to the nail.

Hence, hitherto, the aqueous manicure color having scattered out of the nail was washed away with soap or the like or removed with a pencil remover after drying out of the top coat. The manicure colors once caught in the wrinkles of the skin are, however, difficult to wash off even if they are aqueous and it was often the case that great effort was required for removal or washing-off of the staining colors. In order to cope with the situation a means was taken to coat the skin proximate to the nail with oil and peel off the aqueous manicure color mis-sprayed thereon after drying out of the top coat. This, however, required the effort to wipe off the oil and further wash off the remainder thereof.

SUMMARY OF THE INVENTION

It is the primary object of the present invention to provide a manicure sheet for masking the skin proximate to the nails lest the nail enamel should stain that portion of the skin, also making the contour of the manicure look fine. Another object of the present invention is to provide a manicure sheet which well fits the contour of the nail as it is applied to mask the skin proximate to the nail regardless of the individual difference in the shape and size of nail.

In order to accomplish the aforementioned object, the manicure sheet of the present invention provides a left-and-right pair of masking sheets which are stuck onto the left and right halves of each fingertip. Each masking sheet has formed in the tip portion thereof an L-shaped incision having one basal side corresponding to the nail's basal edge and one perpendicular side corresponding to one of the nail's opposite edges, wherein the sum of the lengths of the basal sides of the left-and-right pair of sheets is larger than that of the basal edge of the nail.

DETAILED DESCRIPTION OF THE INVENTION

Figure 3:
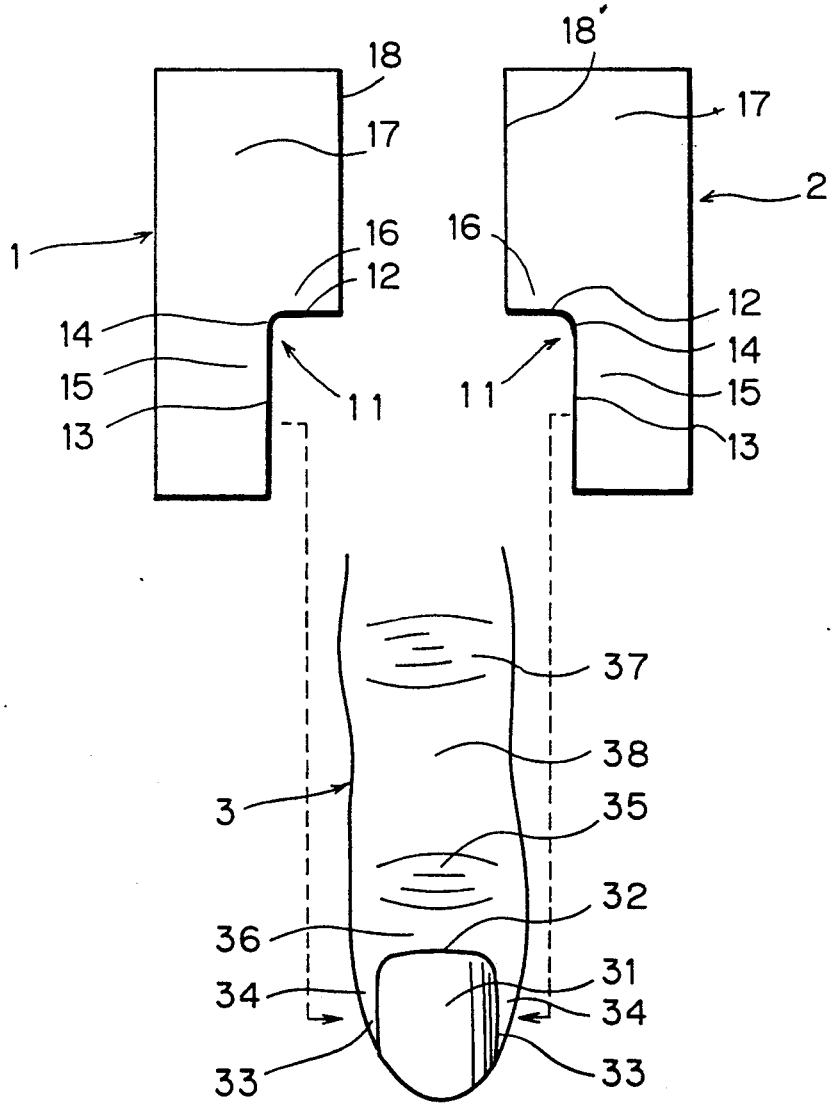
FIG. 3 is a view showing another example of the manicure sheet of the present invention and a fingertip.
Figure 4:
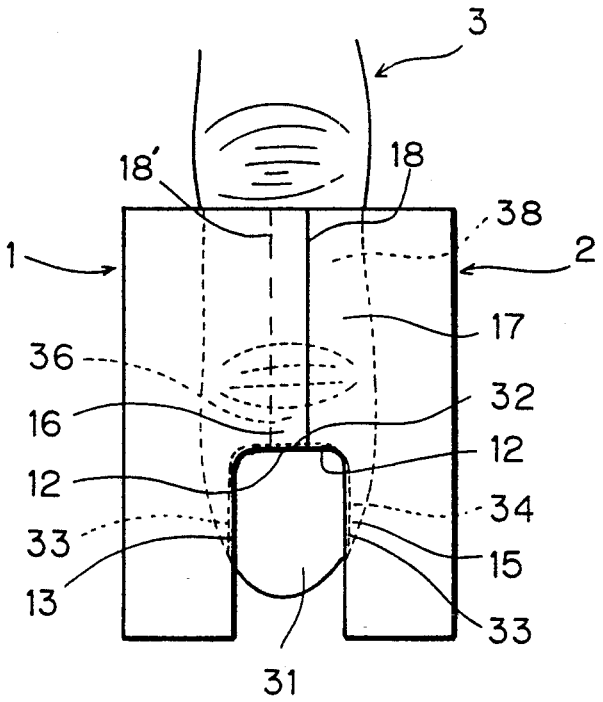
FIG. 4 is a plan view showing a relation between the left-and-right pair of manicure sheet of FIG. 3 combined and positioned on the nail with their L-shaped incision in agreement with the nail's basal edge and one of its opposite edges.

The manicure sheet of the present invention comprises a left-and-right pair of thin paper or plastic masking sheets which are to be stuck onto the left and right halves of the fingertip for masking the skin proximate to the nail. In the tip portion of each sheet there is provided an L-shaped incision having its basal side corresponding to the nail's basal edge (See 32 in FIG. 3.) and the perpendicular side corresponding to either of the opposite edges of the nail. Hence, when the left-and-right pair of masking sheets are put together side by side, there is formed a U-shaped incision in the tip portion of the finger (See FIG. 5–7.). The length of the basal side of the U-shaped incision, that is, the sum of the lengths of the basal sides of the overlapped, confronting L-shaped incisions is made longer than that of the nail's basal edge.

In a preferred example of manicure sheet the basal side and the perpendicular side of the L-shaped incision are connected by a corner of a predetermined radius of curvature or a quarter of oval.

Each left-and-right pair of thin masking sheets normally has an adhesive layer on one side thereof formed by applying a tacky adhesive, which, in turn, is stuck onto a support sheet easily to remove The manicure sheets of the present invention, a multiplicity thereof, can be affixed to a long strip of support sheet in a single row and the sheet then is rolled up for a convenience of use.

The left-and-right pair of masking sheets each having an L-shaped incision in its tip part, are stuck onto the fingertip's left and right halves so overlapped that the the the joined basal sides agree with the nail's basal edge and its perpendicular side with either of the opposite edges of the nail for proper masking of the skin proximate to the nail. Since the sum of the lengths of the L-shaped incisions is made larger than that of the nail's basal edge and the left and right halves of the masking sheet are stuck partly overlapped as mentioned above, the length of the basal side of the U-shaped incision formed by the masking sheets so stuck is freely adjustable. Hence the manicure sheet of the present invention can be stuck onto the skin proximate to the nail easily with their L-shaped incisions, as combined, well matching the basal edge of the nail, regardless of the individual difference with regard to the shape as well as size of the nail. When the nail is coated with a manicure color by, for example, spraying with the proximate skin so masked, the nail alone can be coated precisely with no risk of the proximate skin being stained by the missprayed color, and the contour of the resulting manicure can be finished very fine.

EXAMPLE

Before describing an example of the present invention explanation will be made of the individual parts of finger with reference to the drawings annexed to this specification. In FIGS. 1–4 numeral 3 represents a finger and 31 a nail. The nail 31 is definitely apart from the proximate skin by a basal edge 32 and opposite edges 33 and 34'. In this specification the parts of the skin on both sides of the nail's opposite edges 33 and 33' are called side proximate skin 34, the part of the skin between the nail's basal edge and the first joint (the joint nearest to the fingertip) 35 is called basal proximate skin 36 and the part of the skin between the first joint 35 and the second joint 37 is called intermediate skin 38.

Examples of the present invention will be explained below with reference to the annexed drawings.

The manicure sheet of the present invention comprises a left-and-right pair of masking sheets 1 and 2 which are stuck onto the left and right portions of the fingertip 3 one on the right portion and the other on the left portion thereof so that all parts proximate to the nail 31 are covered by the stuck pair of masking sheets.

Each masking sheet 1, 2 has an L-shaped and inverted L-shaped incision 11 in its tip portion. This incision 11 has the basal side 12 corresponding to the nail's basal side 32 and the perpendicular side 13 corresponding to either of the nail's opposite edges 33 and 33' and continuing to the basal side 13 over a corner 14. In the figure the basal side 12 and the perpendicular side 13 are connected at an angle of approx. 90 degrees but this angle may be modified properly. The basal side 12 and the perpendicular side 13 are shown as straight lines but they may as well be curved. Although the corner 14 is shown as an arc, it may as well be some other kind of curve or even be omitted, the straight contour lines being then joined with no curvature in between.

The sum of the lengths of basal sides 12 and 12 of the left and right masking sheets 1 and 2 is made larger than the length of the nail's basal edge. Although the left-and-right pair of masking sheets 1 and 2 are shown as symmetric ones, they may as well be asymmetric and in that case the length of one basal side may be made smaller than the other.

The size and shape as a whole of the Left-and-right pair of masking sheets may be enough if they can cover the skin proximate to the nail, and in this example there are provided side covering parts 15 to mask the side proximate skin 34 and the basal covering part 16 to cover the basal proximate skin 36 of the skin and an extension 17 is formed to mask the intermediate skin 38. Numerals 18 and 18' represent the sides coming into contact when the left-and-right pair of masking sheets 1 and 2 are placed side by side (See FIGS. 5–7.).

It is very convenient for use to have an adhesive layer by coating a tacky adhesive on the backside of the left-and-right pair of masking sheets 1 and 2. It is then more convenient if a multiplicity of these left-and-right pairs of masking sheets 1 and 2 are stuck to a strip of support sheet like paper. The adhesive layer is not necessarily be formed all over the backside of the sheets 1 and 2. The adhesive layer may be restricted to the area corresponding to the proximate area to the nail and further it is even possible to apply an adhesive immediately before sticking the masking sheet instead of providing an adhesive layer. It is also possible to apply a releasing agent to the side of the support sheet to which the manicure sheets are stuck so as to facilitate easy peeling.

Figure 8:
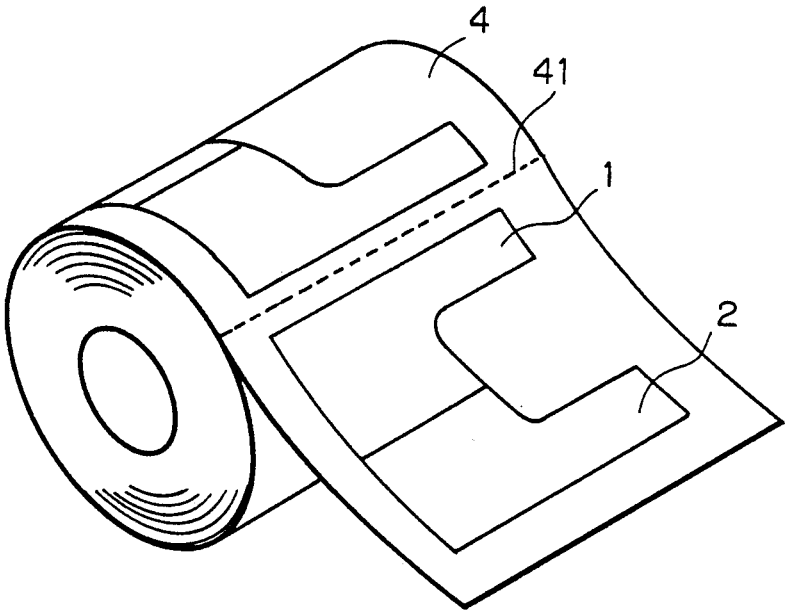
FIG. 8 is a perspective view of still another example of the present invention showing a long strip of paper rolled with a multiplicity of manicure sheets stuck thereto.

A form of commercialized manicure sheet convenient for storage, transport and handling is shown in FIG. 8. It consists of a strip of support sheet 4 with a multiplicity of left-and-right masking sheets stuck thereto and then rolled up. In the FIG. 41 designates a perforation in the strip of sheet to make it separable into units.

Then, explained below is the usage of the manicure sheet of the present invention.

First, the finger 3 is treated. Polish the surface of the nail 31 and, at the same time, trim the scarfskin (thin skin in the border between the nail and the skin) by the aid of a spatula or the like.

Then, coat the nail 31 with the base coat (clear oily nail enamel) by the use of a primer.

Figure 1:
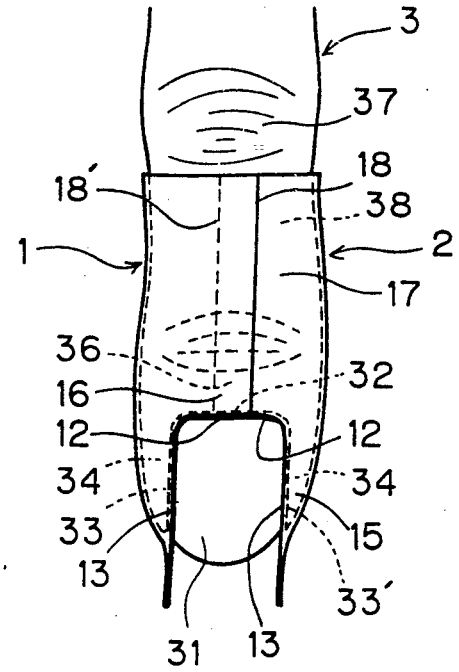
FIG. 1 is a plan view showing a manicure sheet as one example of the present invention stuck onto a human fingertip.
Figure 2:
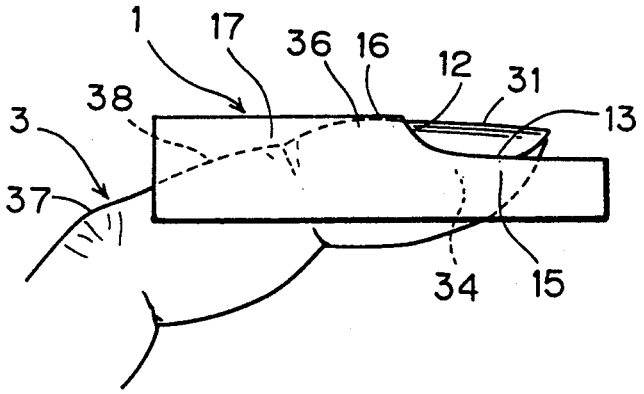
FIG. 2 is a side view showing the same situation as FIG. 1.

After the drying of the base coat the left-and-right pair of mask sheets are stuck onto the finger (FIGS. 1 and 2). More particularly, the mask sheets are peeled off the support sheet (not shown) and then stuck onto the left and right halves of the fingertip. Then, the side covering part 15 of the masking sheet is to be stuck onto the side proximate skin 34, and the basal covering part 16 of the masking sheet is to be stuck onto the basal proximate skin. The extension 17 of the masking sheet extends to the intermediate skin 38 in the illustrated case, but the extension is not absolutely stuck to the skin 38. The masking sheets 1 and 2 are stuck onto the fingertip with the basal side 12 of the sheet's incision 11 to the nail's basal edge 32 or a little inward thereof and the perpendicular side 13 thereof to either of the nail's opposite edges 33 or 33' or a little inward thereof. As mentioned above, the sum of the lengths of the joined basal edges 12, 12 of the left-and-light pair of masking sheets 1 and 2 is set larger than the length of the nail basal edge 32. Hence by sticking the pair of masking sheets 1 and 2 partly overlapped along the sides 18, 18', adjustment is well feasible according to the width of the nail.

Figure 5:
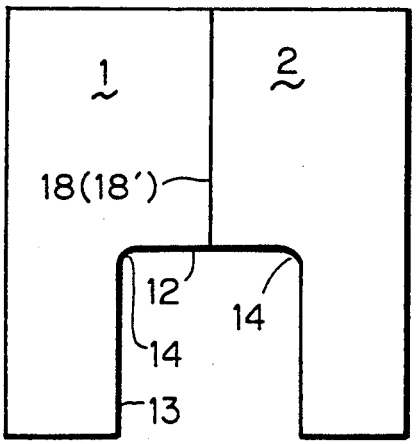
FIGS. 5–7 are plan views showing yet further different examples of the present invention.
Figure 6:
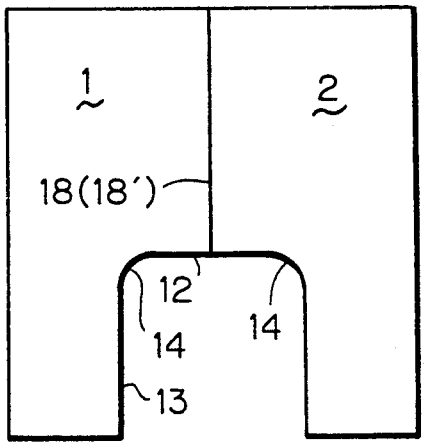
Figure 7:
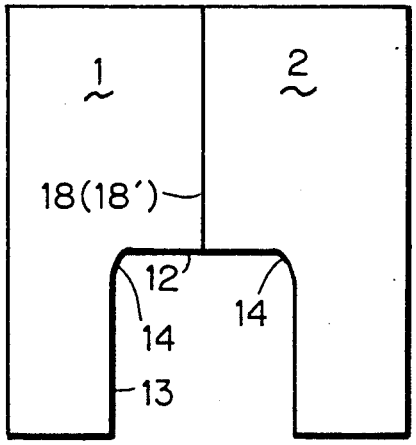

In the examples of the invention, as shown in FIGS. 5–7 there are provided 3 kinds of corner 14. In the example shown in FIG. 5 the corner 14 is a ¼ arc of a circle 2 mm in radius, while in the example shown in FIG. 6 the corner 14 is a ¼ arc of a circle 4 mm in radius. In the example shown in FIG. 7 the corner 14 is a ¼ arc of an oval 4 mm in major axis and 2 mm in minor axis. Normally thumb's nail has its corners ¼ arcs of a circle 2 mm, hence the masking sheets 1 and 2 shown in FIG. 5 are suitable therefor, while the masking sheets 1 and 2 shown in FIG. 6 are suitable for other fingers whose nails have their corner curvature 4 mm in radius. Normally nails of substantially all fingers can be coped with if the masking sheets of FIGS. 5 and 6 are provided. The nails of all fingers can be coped with more surely if the masking sheets of FIG. 7 are provided additionally. Then, aqueous manicure colors are applied by spraying. Since this manicure color dries quickly and forms an extremely thin layer, a variegated colorful pattern can be produced by repeated spraying possibly with colors of different shades. Hitherto aqueous manicure colors, which have been available only as spray colors, have had a defect of staining the skin proximate to the nail. According to the present invention, however, the proximate skin is covered with the masking sheets 1 and 2, hence there is no risk of the color mis-sprayed off the nail staining the skin.

In this example of the invention the masking sheet has its extension 17 to the intermediate skin, hence it is possible to test-spray the aqueous manicure color to see its shade. This test-spraying is a must for the sprayed shade of an aqueous color varies delicately depending on the then ambient temperature, the spraying device used, the manicure color's condition et cetera. Since in this example this test-spraying can be done in the extension 17 nearest to the nail, spraying on the nail can be done continuously after test-spraying in the extension 17 under the same condition. There is, therefore, practically no risk of any difference occurring between test-spraying and spraying on the nail.

For this reason, it is therefore desirous to have the color of the masking sheets 1 and 2, especially the color of the surface of the extension 17 made white or matching the color of the nail's surface.

The shade of each aqueous manicure color and the number of layers of spraying are optional and the masking sheets of the present invention are suitable for mono-color as well as multi-color manicure.

After the drying of the aqueous manicure color, the sheets 1 and 2 are peeled off the skin of each finger and the nail is then brush-coated with the oily top coat. Manicure is over when it dries out and there is no necessity of washing off the mis-sprayed aqueous colors.

Although in the above example of the invention sticking of the masking sheets to the nail was done after the drying of the base coat, it may as well be done before coating of the nail with the base coat. Also, while in the above example spraying was done with aqueous manicure color/s, it may as well be done with oily manicure color/s, and coating may as well be done by brushing.

I claim:

1. A manicure sheet comprising a left-and-right pair of masking sheets (1), (2), each sheet having in a tip part thereof an L-shaped incision (11) defined by a basal side (12) corresponding to nail's basal edge, perpendicular side (13) corresponding to either of nail's opposite edges and a corner (14) of a curve connecting said basal (12) side and said perpendicular side (13) wherein sum of lengths of said joined basal sides (12), (12) is set larger than that of the nail's basal edge so that said masking sheets (1) and (2) can be partly overlapped to match said perpendicular sides (13) with the nail's opposite edges and also to match the nail's basal side with said basal edges (12), (12) and said corner (14) is selectively formed from a plurality of curves of arcs and elliptical arcs.

2. A manicure sheet according to claim 1, wherein a curvature of said corner (14) is selected from three curves at maximum.

3. A manicure sheet according to claim 1 or 2, wherein at least either of said left-and-right pair of masking sheets (1), (2) has an extension (17) reaching the intermediate skin (38) so as to present a space for test spraying of the manicure paint.

4. A manicure sheet according to claim 1 or 2 wherein said left-and-right pair of masking sheets (1), (2) have on the back thereof each one adhesive layer formed by coating with an adhesive so that said masking sheets (1), (2) are stuck on a support sheet (4) readily peelable.

5. A manicure sheet according to claim 4, wherein a plurality of said left-and-right parts of masking sheets (1), (2) are stuck to a strip of the support sheet (4) which is then wound in roll form.

6. A manicure sheet according to claim 3 wherein said left-and-right pair of masking sheets (1), (2) have on the back thereof each one adhesive layer formed by coating with an adhesive so that said masking sheets (1), (2) are stuck on a support sheet (4) readily peelable.

7. A manicure sheet according to claim 6, wherein a plurality of said left-and-right pairs of masking sheets (1), (2) are stuck to a strip of the support sheet (4) which is then wound in a roll form.

* * * * *